US010330121B2

(12) United States Patent
Reynolds et al.

(10) Patent No.: US 10,330,121 B2
(45) Date of Patent: Jun. 25, 2019

(54) SYSTEMS AND METHODS FOR AXIAL COMPRESSOR WITH SECONDARY FLOW

(71) Applicant: HONEYWELL INTERNATIONAL INC., Morristown, NJ (US)

(72) Inventors: Bruce David Reynolds, Chandler, AZ (US); David Richard Hanson, Tempe, AZ (US); John Repp, Gilbert, AZ (US); Michael Todd Barton, Phoenix, AZ (US); John A. Gunaraj, Chandler, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 530 days.

(21) Appl. No.: 14/632,024

(22) Filed: Feb. 26, 2015

(65) Prior Publication Data

US 2016/0252098 A1 Sep. 1, 2016

(51) Int. Cl.

| | |
|---|---|
| ***F01D 9/06*** | (2006.01) |
| ***F04D 27/02*** | (2006.01) |
| ***F04D 29/52*** | (2006.01) |
| ***F04D 29/68*** | (2006.01) |

(52) U.S. Cl.

CPC ..... *F04D 29/684* (2013.01); *F01D 9/065* (2013.01); *F04D 27/0215* (2013.01); *F04D 27/0238* (2013.01); *F04D 29/522* (2013.01); *F04D 29/682* (2013.01); *F05D 2270/10* (2013.01); *F05D 2270/101* (2013.01)

(58) Field of Classification Search

CPC .... F04D 29/682; F04D 29/684; F04D 29/522; F04D 27/0238; F04D 27/0215; F01D 9/065; F01D 25/24

See application file for complete search history.

(56) References Cited

U.S. PATENT DOCUMENTS

| | | | |
|---|---|---|---|
| 5,707,206 A | 1/1998 | Goto et al. | |
| 6,098,010 A | 8/2000 | Krener et al. | |
| 8,162,591 B2 | 4/2012 | Grauer | |
| 8,210,794 B2 * | 7/2012 | Nolcheff | F04D 17/025 415/228 |

(Continued)

FOREIGN PATENT DOCUMENTS

| | | |
|---|---|---|
| CN | 102852668 A | 1/2013 |
| GB | 1051406 A1 | 12/1966 |

OTHER PUBLICATIONS

Dandrea, R. et al.; Active Control of an Axial Flow Compressor via Pulsed Air Injection; Division of Engineering and Applied Science, California Institute of Technology, Pasadena California CDS Technical Report CIT/CDS 95-029; Submitted, ASME J. Turbomachinery; Revised, Jul. 1996.

(Continued)

*Primary Examiner* — Ninh H. Nguyen

*Assistant Examiner* — Brian P Wolcott

(74) *Attorney, Agent, or Firm* — Lorenz & Kopf, LLP

(57) ABSTRACT

Methods and apparatuses are provided for a compressor. The compressor includes a first stage having a first rotor and a first stator, and a second stage downstream from the first stage in a direction of a fluid flow. The compressor also includes a secondary flow system that directs fluid from the second stage into the first stator to improve at least one of a performance and a stability of the compressor.

9 Claims, 7 Drawing Sheets

(56) References Cited

U.S. PATENT DOCUMENTS

| | | | | |
|---|---|---|---|---|
| 8,403,630 | B2 * | 3/2013 | Guemmer | F01D 9/065 415/110 |
| 8,491,254 | B2 | 7/2013 | Domereq et al. | |
| 2004/0081552 | A1 | 4/2004 | Guemmer | |
| 2009/0047126 | A1 * | 2/2009 | Ress, Jr. | F01D 9/041 415/209.3 |
| 2010/0098527 | A1 * | 4/2010 | Guemmer | F04D 29/681 415/115 |
| 2011/0076133 | A1 | 3/2011 | Agneray et al. | |

OTHER PUBLICATIONS

Day, I.J.; Active Suppression of Rotating Stall and Surge in Axial Compressors; vol. 115, Jan. 1993 Transactions of the ASME; Copyright 1993 by ASME.

Extended EP Search Report for Application No. 16155778.0-1607 dated Jul. 14, 2016.

* cited by examiner

SYSTEMS AND METHODS FOR AXIAL COMPRESSOR WITH SECONDARY FLOW

TECHNICAL FIELD

The present disclosure generally relates to compressors, and more particularly relates to systems and methods for an axial compressor with a secondary fluid flow to improve at least one of a performance and a stability of the axial compressor.

BACKGROUND

Compressors can be used in a variety of applications, and for example, compressors, such as axial compressors, may be part of a gas turbine engine. Generally, compressors include multiple stages, where each stage includes a rotor and a stator. In multistage compressors, there may be a progressive reduction in stage pressure ratio, such that a rear stage develops a lower pressure ratio than a first stage. As the performance of the compressor can be defined by the maximum overall pressure ratio that can be achieved for a given mass flow, the lower pressure ratio in the rear stage may limit the performance and stability of the compressor.

Accordingly, it is desirable to provide systems and methods for an axial compressor with a secondary fluid flow to improve at least one of a performance and a stability of the axial compressor. Furthermore, other desirable features and characteristics of the present invention will become apparent from the subsequent detailed description and the appended claims, taken in conjunction with the accompanying drawings and the foregoing technical field and background.

SUMMARY

According to various embodiments, a compressor is provided. The compressor comprises a first stage having a first rotor and a first stator and a second stage downstream from the first stage in a direction of a fluid flow. The compressor also comprises a secondary flow system that directs fluid from the second stage into the first stator to improve at least one of a performance and a stability of the compressor.

A method of improving at least one of a performance and a stability of an axial compressor is provided according to various embodiments. The axial compressor includes a first stage upstream from a second stage in a direction of a main fluid flow. In one embodiment, the method includes receiving a secondary fluid having a first static pressure; and directing the secondary fluid into a first stator of the first stage to disrupt a main fluid flow through the first stator, the main fluid flow through the first stator having a second static pressure that is different than the first static pressure.

Also provided according to various embodiments is an axial compressor. The axial compressor comprises a first stage having a first rotor and a first stator and a second stage having a second rotor and a second stator. The second stage is downstream from the first stage in a direction of an air flow. The axial compressor also comprises a secondary air flow system that directs air adjacent to the second stator into the first stator to disrupt the air flow through the first stator.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description. In addition, those skilled in the art will appreciate that embodiments of the present disclosure may be practiced in conjunction with any type of compressor, and that the axial compressor described herein is merely one exemplary embodiment of the present disclosure. It should be noted that many alternative or additional functional relationships or physical connections may be present in an embodiment of the present disclosure. As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

Figure 1:
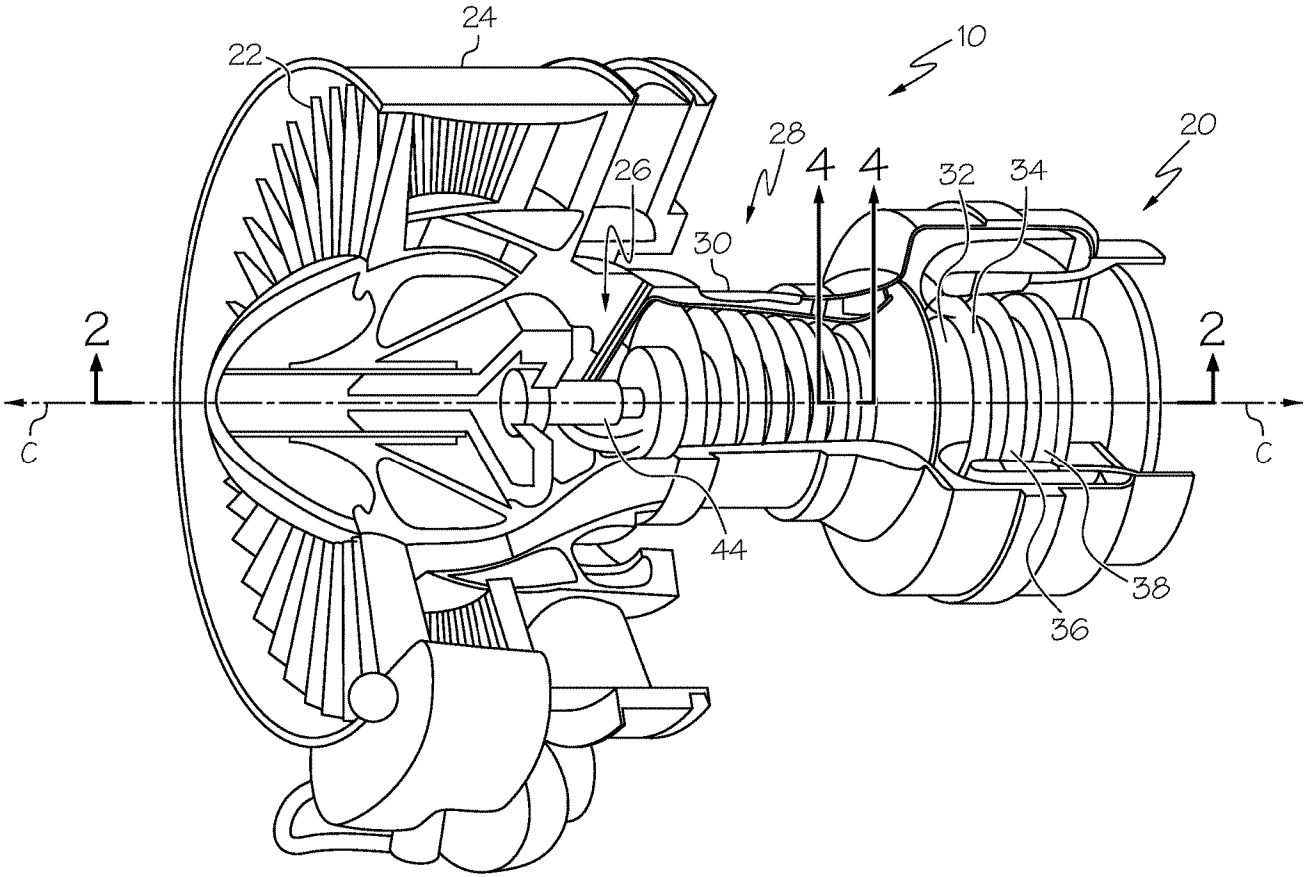
FIG. 1 is a schematic partially cut-away illustration of a gas turbine engine that includes an axial compressor with a secondary fluid flow in accordance with various embodiments.
Figure 2:
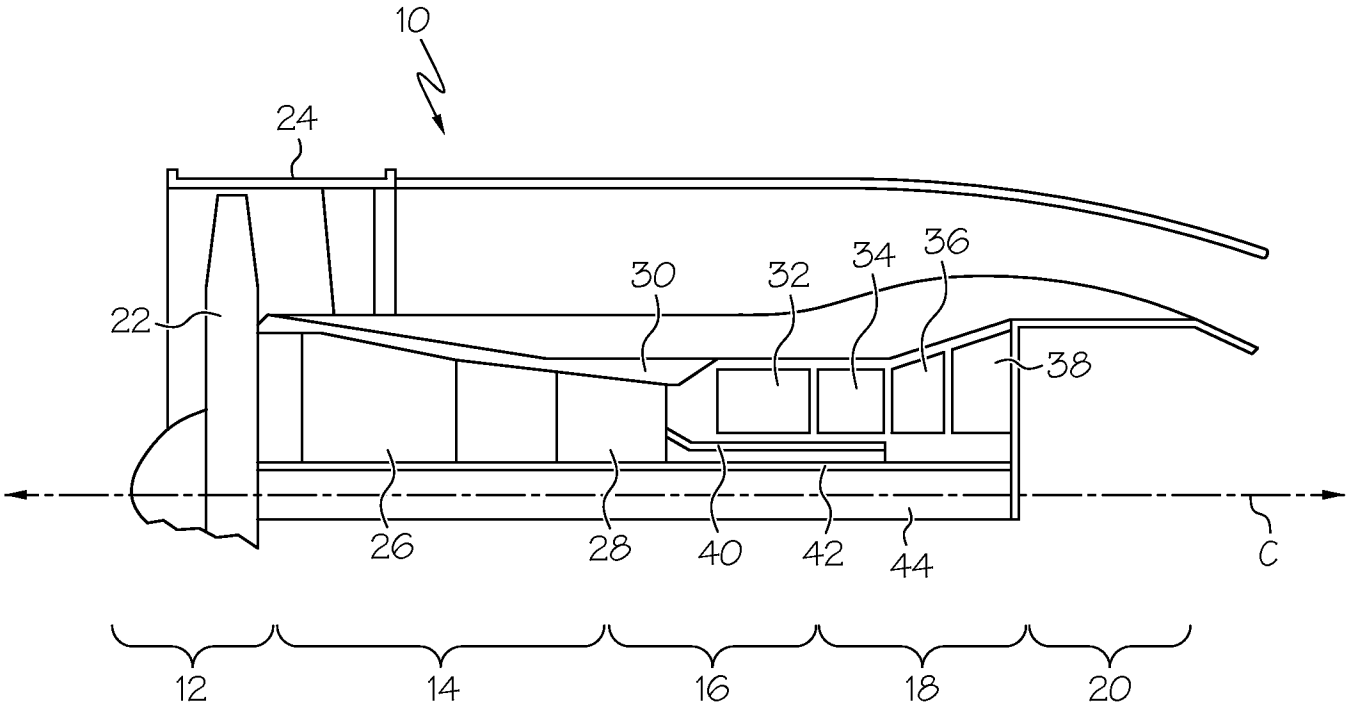
FIG. 2 is a schematic cross-sectional illustration of the gas turbine engine of FIG. 1, taken along line 2-2 of FIG. 1.

With reference to FIGS. 1 and 2, an exemplary gas turbine engine 10 is shown, which includes a secondary air flow system according to various embodiments. It should be noted that while the secondary air flow system is discussed herein with regard to a gas turbine engine 10, the secondary air flow system can be employed with any suitable engine, such as a turbojet engine, a scramjet engine, an auxiliary power unit (APU), etc. Thus, the following description is merely one exemplary use of the secondary air flow system. In this example, the exemplary gas turbine engine 10 includes a fan section 12, a compressor section 14, a combustion section 16, a turbine section 18, and an exhaust section 20. As the fan section 12, the combustion section 16, the turbine section 18 and the exhaust section 20 can be substantially similar to a fan section, combustion section, turbine section and exhaust section associated with a conventional gas turbine engine, the fan section 12, the combustion section 16, the turbine section 18 and the exhaust section 20 will not be discussed in great detail herein. In addition, although the figures shown herein depict an example with certain arrangements of elements, additional intervening elements, devices, features, or components may be present in an actual embodiment. It should also be understood that FIGS. 1 and 2 are merely illustrative and may not be drawn to scale. In addition, while the fluid discussed herein is described as air, it should be noted that the various teachings of present disclosure is not so limited, but rather, any suitable fluid can be employed.

The fan section 12 includes a fan 22 mounted in a fan casing 24. The fan 22 induces air from the surrounding environment into the engine and passes a fraction of this air toward the compressor section 14. The compressor section 14 includes at least one compressor and, in this example, includes a low-pressure (LP) compressor 26 (may also be referred to as an intermediate-pressure (IP) compressor, a booster or T-stage) and a high-pressure (HP) compressor 28. The LP compressor 26 raises the pressure of the air directed into it from the fan 22 and directs the compressed air into the HP compressor 28. The LP compressor 26 and the HP compressor 28 may be axi-symmetrical about a longitudinal centerline axis C. The LP compressor 26 and the HP compressor 28 are mounted in a compressor casing 30 (hereinafter referred to as a shroud 30).

Still referring to FIG. 2, the combustion section 16 of gas turbine engine 10 includes a combustor 32 in which the high pressure air from the HP compressor 28 is mixed with fuel and combusted to generate a combustion mixture of air and fuel. The combustion mixture is then directed into the turbine section 18. The turbine section 18 includes a number of turbines disposed in axial flow series. FIG. 2 depicts a high pressure turbine 34, an intermediate pressure turbine 36, and a low pressure turbine 38. While three turbines are depicted, it is to be understood that any number of turbines may be included according to design specifics. For example, a propulsion gas turbine engine may comprise only a high pressure turbine and a low pressure turbine. The combustion mixture from the combustion section 16 expands through each turbine 34, 36, 38, causing them to rotate. As the turbines 34, 36, 38 rotate, each respectively drives equipment in the gas turbine engine 10 via concentrically disposed spools or shafts 40, 42, 44. The combustion mixture is then exhausted through the exhaust section 20.

Figure 3:
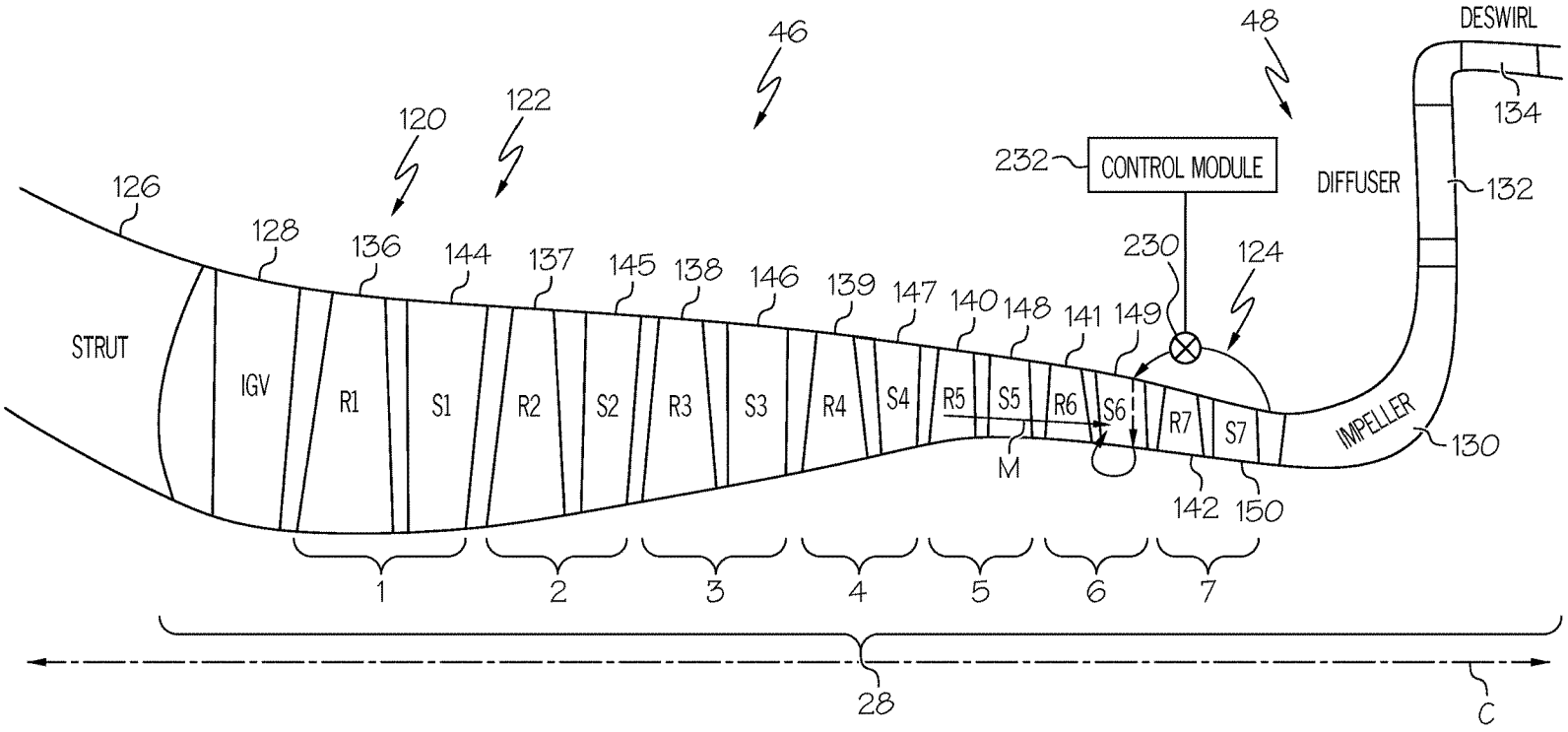
FIG. 3 is a schematic meridional sectional view through a portion of the axial compressor of FIG. 1.

With reference to FIG. 3, a schematic meridional sectional view through a portion of the HP compressor 28 is shown. In this example, the HP compressor 28 includes an axial compressor section 46 and a centrifugal compressor section 48. The axial compressor section 46 includes one or more rotors 120, one or more stators 122 and a secondary flow system or secondary air flow system 124 (schematically illustrated by reference numeral 124). The one or more rotors 120 and the one or more stators 122 are enclosed by the shroud 30 (FIG. 2), and in one example, the secondary air flow system 124 can also be enclosed by the shroud 30. The axial compressor section 46 can also include a strut 126 and an inlet guide vane system 128. The centrifugal compressor section 48 can include an impeller 130, a diffuser 132 and a deswirl section 134. Since the strut 126, inlet guide vane system 128, impeller 130, diffuser 132 and deswirl section 134 are generally known in the art, they will not be discussed in great detail herein.

With continued reference to FIG. 3, the axial compressor section 46 includes one or more compressor stages spaced in an axial direction along the longitudinal centerline axis C, with the one or more rotors 120 and the one or more stators 122 cooperating to define a stage. In one example, the axial compressor section 46 comprises a seven stage axial compressor. It should be noted, however, that the axial compressor section 46 can include any number of stages, and thus, the number of stages illustrated and described herein is merely exemplary. Furthermore, the secondary air flow system 124 can be employed with an axial compressor section 46 having any number of stages, and thus, it will be understood that the present teachings herein are not limited to an axial compressor section 46 having seven stages.

In this example, the one or more rotors 120 includes seven rotors 136, 137, 138, 139, 140, 141, 142 and the one or more stators 122 includes seven stators 144, 145, 146, 147, 148, 149, 150. The seven rotors 136-142 and seven stators 144-150 cooperate to define seven stages of the axial compressor section 46, with rotor 136 and stator 144 forming stage 1, rotor 137 and stator 145 forming stage 2, rotor 138 and stator 146 forming stage 3, rotor 139 and stator 147 forming stage 4, rotor 140 and stator 148 forming stage 5, rotor 141 and stator 149 forming stage 6 and rotor 142 and stator 150 forming stage 7. It should be noted that the number of rotors, number of stators and number of stages associated with the axial compressor section 46 is merely exemplary, as the axial compressor section 46 can include any number of rotors, stators and stages. In addition, it will be understood that the flow of air through the axial compressor section 46 is that viewed from the stator frame of reference.

Figure 4:
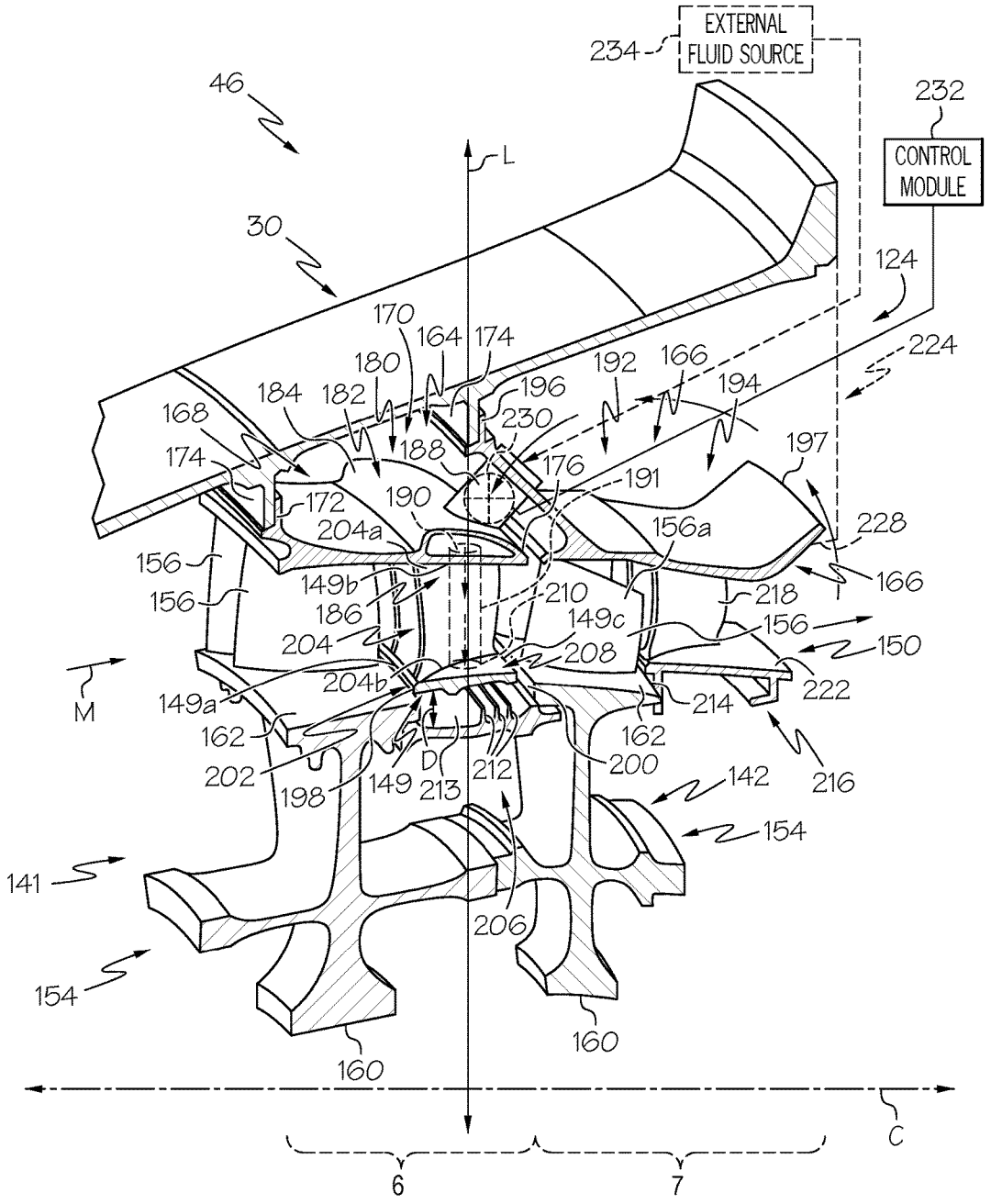
FIG. 4 is a detail cross-sectional view of a portion of the axial compressor of FIG. 1, as indicated by line 4-4 in FIG. 1.

With regard to FIG. 4, stage 6 and stage 7 of the axial compressor section 46 are shown in greater detail. As will be discussed in greater detail herein, in this example, the stage 6 and stage 7 flowfield of the axial compressor section 46 cooperate with the secondary air flow system 124. It should be noted that while stage 6 and stage 7 are described and illustrated herein as cooperating with the secondary air flow system 124, stage 1, stage 2, stage 3, stage 4 and/or stage 5 can cooperate with the secondary air flow system 124, if desired. Thus, the following description and the various teachings of the present disclosure are not limited to stage 6 and stage 7.

With regard to FIG. 4, the rotors 141-142 each include a disk 154 and a plurality of blades 156. The disk 154 of each of the rotors 141-142 are coupled to the shaft 44 associated with the gas turbine engine 10 (FIG. 2). The shaft 44 rotates each of the rotors 141-142 at a desired speed. In this example, the disk 154 is annular and is coupled to the shaft 44 about a bore 160 defined along a central axis of the disk 154. The disks 154 are sized and shaped to cooperate with fore and aft bearings as is generally known, to couple the respective rotor 141-142 to the shaft 44 for rotation. The disk 154 of each of the rotors 141-142 also defines a perimeter or circumference 162. In this example, the blades 156 are coupled to the circumference 162 of the disk 154. Generally, the blades 156 are formed or cast with the disk 154, however, the blades 156 can be coupled to the disk 154 through a suitable technique, such as welding, or the individual blades 156 can be inserted into and retained in slots defined in the disk 154.

The blades 156 are coupled to the disk 154 of each of the rotors 141-142 along the circumference 162 to turn and accelerate a fluid in the stator frame of reference, such as air, as the fluid moves through or past the blades 156. It should be noted that this particular arrangement of the blades 156 on each of the rotors 141-142 is merely exemplary, as the rotors 141-142 can have any desired number and arrangement of blades 156 to turn and accelerate the fluid as desired. Further, it should be noted that the blades 156 accelerate the fluid from a stationary frame of reference or a stator frame of reference. The blades 156 of each of the rotors 141-142 extend outwardly, radially or in a direction away from the central axis of the rotors 141-142 towards a respective one of a sixth stage shroud housing 164 and a seventh stage shroud housing 166. Thus, the sixth stage shroud housing 164 and the seventh stage shroud housing 166 can enclose a respective stage of the axial compressor section 46. For example, the sixth stage shroud housing 164 can enclose the rotor 141 and the stator 149 (stage 6), and the seventh stage shroud housing 166 can enclose the rotor 142 and the stator 150 (stage 7). As will be discussed in greater detail below, at least the sixth stage shroud housing 164 cooperates with the secondary air flow system 124.

With continued reference to FIG. 4, the sixth stage shroud housing 164 includes a rotor portion 168 and a stator portion 170. In one example, the rotor portion 168 includes a mating extension 172 to couple the sixth stage shroud housing 164 to a corresponding extension 174 of the shroud 30. The rotor portion 168 extends generally in an axial direction relative to the centerline C of the gas turbine engine 10 and substantially perpendicular to an axis of the blades 156. The rotor portion 168 generally extends from an area adjacent to the extension 174 of the shroud 30 to an area adjacent to the stator 149, and serves to substantially enclose the rotor 141.

The stator portion 170 is coupled to the rotor portion 168 and to the stator 149. In one example, the rotor portion 168 can be integrally formed with the stator portion 170; however, the rotor portion 168 and the stator portion 170 can comprise discrete components coupled together via a suitable technique, such as welding, mechanical fasteners, etc., if desired. The stator portion 170 substantially extends from the rotor portion 168 to a terminal end 176. Generally, the terminal end 176 of the stator portion 170 lies in the same plane as an end 178 of the stator 149. In this example, the terminal end 176 of the stator portion 170 is spaced a distance apart or away from the seventh stage shroud housing 166, however, the sixth stage shroud housing 164 and seventh stage shroud housing 166 can be coupled together, if desired.

The stator portion 170 defines a plenum 180. The plenum 180 is in communication with the secondary air flow system 124, as will be discussed further herein. In one example, the plenum 180 includes a first side 182, a second side 184 and a third side 186, which cooperate to define a chamber over the stator 149. It should be noted that the shape and number of sides associated with the plenum 180 is merely exemplary, as the plenum 180 can have any desired shape to facilitate a secondary air flow through the stator 149. In addition, it should be noted that the use of the plenum 180 is merely exemplary. For example, a secondary air flow can be introduced into the stator 149 via any suitable technique, such as the use of a strut, tube or a pipe that directs a secondary air flow into the stator 149. Thus, the secondary air flow need not be directed into one or more interior passages 191 of the stator 149, as discussed further herein. Further, the secondary air flow need not be directed into the stator 149. Rather, the secondary air flow can be directed in front of the stator 149, in a direction substantially perpendicular to the main gas path air flow M to disrupt the flow of air through the stator 149.

In this example, the first side 182 of the plenum 180 defines at least one conduit or tube 188, which is in communication with a portion of the secondary air flow system 124 to receive air from the secondary air flow system 124. In one example, the first side 182 can include two to four tubes 188 spaced apart along a perimeter or circumference of the first side 182, however, it will be understood that the first side 182 can include any number of tubes 188, such as a single tube 188, in communication with the secondary air flow system 124. In addition, it should be noted that while the tube 188 is illustrated herein as being defined near a middle of the first side 182, the tube 188 can be defined through the second side 184, if desired. Thus, the location of the tube 188 relative to the plenum 180 illustrated herein is merely exemplary.

The first side 182 is coupled to the second side 184 and the third side 186. The second side 184 is adjacent to the rotor portion 168 and is coupled to the third side 186. The third side 186 defines one or more openings 190 through which air from the plenum 180 can flow into one or more interior passages 191 in the stator 149. In one example, the one or more openings 190 are substantially cylindrical, however, the one or more openings 190 can have any desired geometrical shape, such as rectangular, etc. Generally, the third side 186 can define about one opening 190 to about a number of openings 190 equal to a number of interior passages 191 defined in the stator 149 around a perimeter or a circumference of the third side 186 to enable air from the plenum 180 to enter the one or more interior passages 191 of the stator 149. It should be noted that the number of openings 190 is merely exemplary, as the third side 188 can have any number of openings 190 based on the desired secondary air flow into the stator 149. The third side 188 can be coupled to the stator 149.

The seventh stage shroud housing 166 includes a rotor portion 192 and a stator portion 194. In one example, the rotor portion 192 includes a mating extension 196 to couple the seventh stage shroud housing 166 to the corresponding extension 174 of the shroud 30. The rotor portion 192 extends generally in an axial direction relative to the centerline C of the gas turbine engine 10 and substantially perpendicular to an axis of the blades 156. The rotor portion 192 generally extends from an area adjacent to the extension 174 of the shroud 30 to an area adjacent to the stator 150, and serves to substantially enclose the rotor 142.

The stator portion 194 is coupled to the rotor portion 192 and to the stator 150. In one example, the rotor portion 192 can be integrally formed with the stator portion 194; however, the rotor portion 192 and the stator portion 194 can comprise discrete components coupled together via a suitable technique, such as welding, mechanical fasteners, etc. The stator portion 194 substantially extends from the rotor portion 192 to a terminal end 197. In this example, the terminal end 197 of the stator portion 194 extends outwardly or along an axis substantially transverse to a longitudinal axis of the stator portion 194.

With continued reference to FIG. 4, the stator 149 is positioned between the rotor 141 and the rotor 142, and is coupled to the stator portion 170 of the sixth stage shroud housing 164. Generally, the stator 149 is positioned between the rotor 141 and the rotor 142 such that a first gap 198 is defined between the stator 149 and the rotor 141 and a second gap 200 is defined between the stator 149 and the rotor 142. It should be noted that the first gap 198 between rotor 141 and the stator 149 need not be the same size or dimension as the second gap 200 between the rotor 142 and the stator 149. The first gap 198 facilitates the movement of the rotor 141 relative to the stator 149, and the second gap 200 facilitates the movement of the rotor 142 relative to the stator 149. As will be discussed, the first gap 198 also enables a secondary air flow through the stator 149 to exit into a main gas path air flow M (FIG. 3).

The stator 149 is fixed or stationary relative to the rotors 141-142, and does not move or rotate with the shaft 44. The stator 149 includes a hub 202, one or more vanes 204 and in this example, the stator 149 is positioned above a rotating seal 206. In one example, the hub 202 and the one or more vanes 204 can be integrally formed together, via a suitable casting process, but one or more of the hub 202 and the one or more vanes 204 can be formed as discrete components and coupled together through a suitable technique, such as welding, for example. The hub 202 can be substantially annular, and can comprise a ring. The hub 202 includes a perimeter or circumference 208, and one or more openings 210 can be defined through the circumference 208.

As will be discussed, the one or more openings 210 enable air from the secondary air flow system 124 to flow through one or more interior passages 191 in the stator 149 and into a hub cavity 213 defined between the hub 202 and the rotating seal 206. It should be noted that the hub cavity 213 need not be defined by a rotating seal, and that a hub cavity can be defined by the hub 202 itself. Thus, the use of the rotating seal 206 is merely exemplary. Generally, the interior passages 191 in the stator 149 are defined through one or more of the vanes 204. Stated another way, one or more of the vanes 204 of the stator 149 defines an interior passage 191. In one example, the interior passage 191 extends from an end 204*a* of the vane 204 adjacent to the opening 190 to an end 204*b* of the vane 204 adjacent to the rotating seal 206. It should be noted that while a single interior passage 191 is illustrated herein, the stator 149 can include any number of interior passages 191, from one to about the number of vanes 204 associated with the stator 149. Furthermore, the number of interior passages 191 need not be equal to the number of openings 190, if desired.

The air from the secondary air flow system 124 flows through the interior passages 191, into a hub cavity 213, or the area defined between the hub 202 and the rotating seal 206. In one example, the one or more openings 210 are substantially cylindrical, however, the one or more openings 210 can have any desired geometrical shape, such as rectangular, etc. Generally, the one or more openings 210 are defined through the circumference 208 such that a respective one of the openings 210 is aligned with a respective one of the interior passages 191 to ensure air flow through the hub 202 into the hub cavity 213. Generally, the circumference 208 can define about one to about a number of openings 210 about equal to the number of vanes 204 to enable air from the stator 149 to enter the hub cavity 213. It should be noted that the number of openings 210 is merely exemplary, as the circumference 208 can have any number of openings 210 based on the desired air flow through the stator 149. Furthermore, as discussed previously, the secondary air flow can be introduced into the hub 202 of the stator 149 via any suitable technique, and thus, the secondary air flow need not be directed into one or more vanes 204 of the stator 149.

The vanes 204 are coupled to the circumference 208 of the hub 202 and the stator portion 170 of the sixth stage shroud housing 164 at a first end 149*b* of the stator 149. It should be noted that while the stator 149 is described herein as being coupled to the sixth stage shroud housing 164 at the first end 149*b*, the stator 149 can be coupled to the axial compressor section 46 so as to be fixed via any suitable technique. The vanes 204 are coupled to the hub 202 of the stator 149 along the circumference 208. The vanes 204 increase the static pressure of the air and direct or guide the air as the air moves through the vanes 204. It should be noted that this particular arrangement of the vanes 204 on the stator 149 is merely exemplary, as the stator 149 can have any desired number and arrangement of vanes 204 to increase the static pressure of the air and direct or guide the air as desired. As discussed, one or more of the vanes 204 can include the interior passage 191. The interior passage 191 permits a secondary air flow through the stator 149, as will be discussed in greater detail herein.

Figure 5:
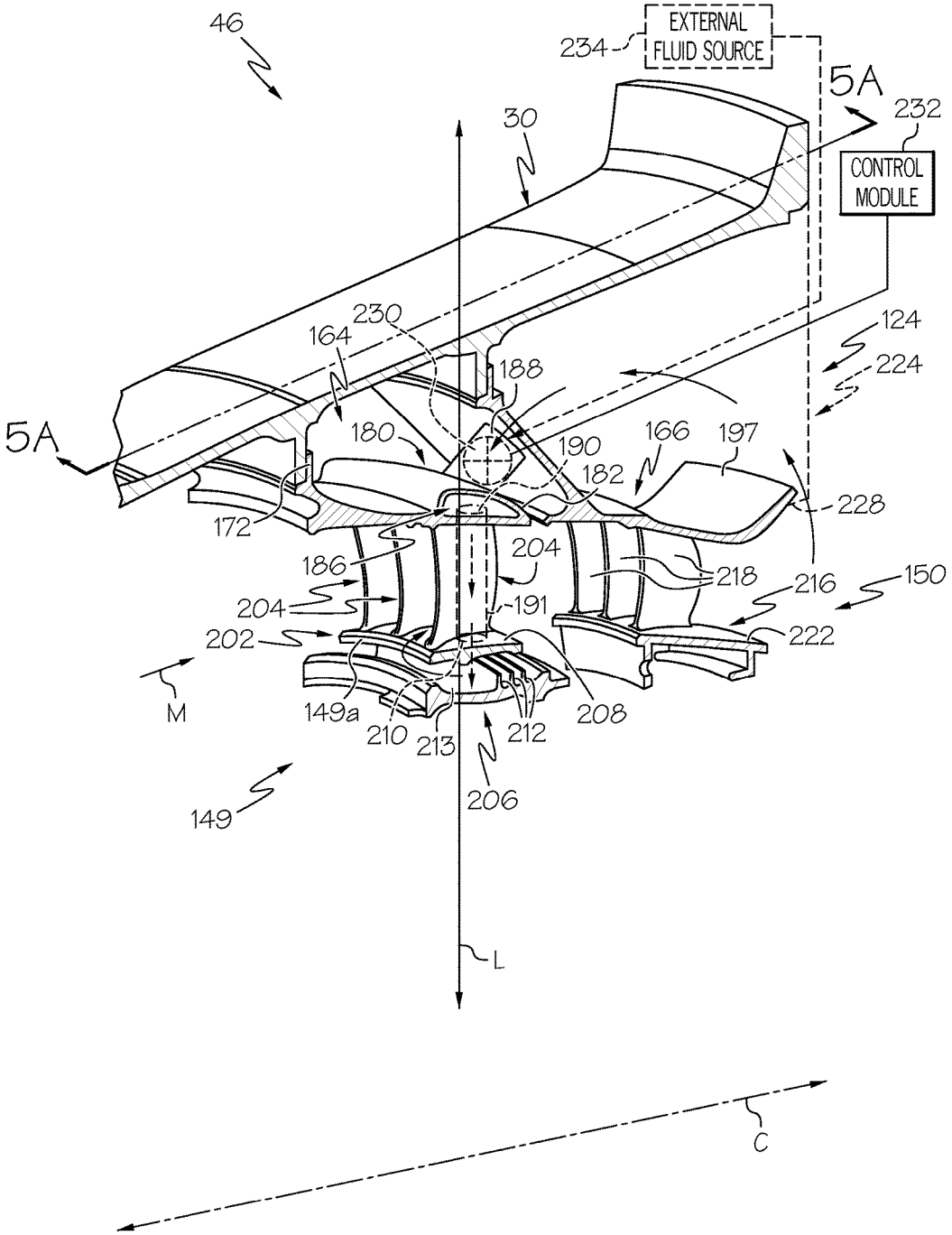
FIG. 5 is a simplified view of the cross-section of FIG. 4.

The rotating seal 206 can be coupled to the disk 154 of the rotor 141 adjacent to the circumference 162 of the rotor 141. It should be noted that the coupling of the rotating seal 206 to the rotor 141 is merely exemplary. In one example, the rotating seal 206 is coupled to the rotor 141 so as to be disposed a distance D away from the hub 202 of the stator 149 or from a second end 149*c* of the stator 149. With reference to FIGS. 4 and 5, the rotating seal 206 serves to reduce a leakage of air around the stator 149. The rotating seal 206 also redirects and controls the amount of the air from an exit of the stator 149 toward a front or first side 149*a* of the stator 149. In this regard, in one example, the rotating seal 206 includes at least one seal 212. In this example, the rotating seal 206 includes three seals 212, which serve to substantially restrict a flow of air towards the rotor 142. Stated another way, the seals 212 substantially control the amount of the air flow from the stator 149 towards the first side 149*a* of the stator 149 to reduce fluid leakage around the hub 202 of the stator 149.

With continued reference to FIG. 4, the stator 150 is positioned adjacent to the rotor 142, and is coupled to the stator portion 194 of the seventh stage shroud housing 166. Generally, the stator 150 is positioned adjacent to the rotor 142 such that a third gap 214 is defined between the stator 150 and the rotor 142. The third gap 214 allows the movement of the rotor 142 relative to the stator 150. The stator 150 is fixed or stationary relative to the rotor 142, and does not move or rotate with the shaft 44. The stator 150 includes a hub 216 and one or more vanes 218. In one example, the hub 216 and the one or more vanes 218 can be integrally formed together, via a suitable casting process, but one or more of the hub 216 and the one or more vanes 218 can be formed as discrete components and coupled together through a suitable technique, such as welding, for example.

The hub 216 can be substantially annular, and can comprise a ring. The hub 216 includes a perimeter or circumference 222. The vanes 218 are coupled to the circumference 222 of the hub 216 and the stator portion 194 of the seventh stage shroud housing 166. It should be noted that while the stator 150 is described herein as being coupled to the seventh stage shroud housing 166, the stator 150 can be coupled to the axial compressor section 46 so as to be fixed or stationary relative to the rotor 142 via any suitable technique. The vanes 218 are coupled to the hub 216 of the stator 150 along the circumference 222. The vanes 218 increase the static pressure of the air and direct or guide the air as the air moves through the vanes 218. It should be noted that this particular arrangement of the vanes 218 on the stator 150 is merely exemplary, as the stator 150 can have any desired number and arrangement of vanes 218 to increase the static pressure of the air and direct or guide the air as desired.

With reference to FIG. 3, the secondary air flow system 124 directs air from a higher static pressure stage of the axial compressor section 46 into lower static pressure stage of the axial compressor section 46. In this regard, the static pressure of the air in the axial compressor section 46 increases with each stage of the axial compressor section 46 (i.e. the static air pressure increases as the air flows downstream).

Thus, the air in stage 2 has a higher static pressure than the air in stage 1, the air in stage 3 has a higher static pressure than the air in stage 2 and stage 1, the air in stage 4 has a higher static pressure than the air in stage 3-1, the air in stage 5 has a higher static pressure than the air in stages 4-1, the air in stage 6 has a higher static pressure than the air in stages 5-1 and the air in stage 7 has a higher static pressure than the air in stages 6-1. By injecting higher static pressure air into a lower static pressure air flow at the hub of the respective stator 144-149, the hub air flow in the lower static pressure stator 144-149 is disrupted, which causes the main gas path air flow M or the air flowing through the stator 144-149 from an upstream rotor 136-141 to be directed towards the terminal ends or tips of the respective blades of the respective rotor 138-142 of the adjacent stage. In this example, the secondary air flow system 124 will be described herein as directing higher static pressure air from stage 7 into the stator 149 of lower static pressure stage 6. It should be understood that this particular example of the secondary air flow system 124 is merely exemplary, as the teachings of the secondary air flow system 124 can be applied or used to direct downstream air to any desired upstream stator 144-149 to disrupt or destabilize the flow of air through the hub of the respective upstream stator 144-149.

For example, the secondary air flow system 124 can direct air from stage 7 into the stator 149 of stage 6, the stator 148 of stage 5, the stator 147 of stage 4, the stator 146 of stage 3, the stator 145 of stage 2 and/or the stator 144 of stage 1. The secondary air flow system 124 can also direct air from stage 6 into the stators 148 of stage 5, the stator 147 of stage 4, the stator 146 of stage 3, the stator 145 of stage 2 and/or the stator 144 of stage 1. Further, the secondary air flow system 124 can direct air from stage 5 to the stator 147 of stage 4, the stator 146 of stage 3, the stator 145 of stage 2 and/or the stator 144 of stage 1. Similarly, the secondary air flow system 124 can direct air from stage 4 to the stator 146 of stage 3, the stator 145 of stage 2 and/or the stator 144 of stage 1. The secondary air flow system 124 can also direct air from stage 3 to the stator 145 of stage 2 and/or the stator 144 of stage 1. The secondary air flow system 124 can also direct air from stage 2 to the stator 144 of stage 1. Thus, the following description is merely an exemplary embodiment for the secondary air flow system 124. Moreover, while a single secondary air flow system 124 is described herein as directing fluid from a single high static pressure stage to a single low static pressure stage, the secondary air flow system 124 can direct air from a single high static pressure stage to multiple low static pressure stages. Thus, the secondary air flow system 124 is not limited to directing downstream fluid from a stage of the axial compressor section 46 to a single stage of the axial compressor section 46 upstream. Furthermore, the secondary air flow system 124 is not limited to directing air from a downstream stage to an adjacent upstream stage. Rather, the secondary air flow system 124 can direct higher static pressure air to any lower static pressure air stator 144, 145, 146, 147, 148, 149.

Furthermore, the secondary air flow system 124 need not direct air from a stage of the axial compressor section 46 to an upstream stage of the axial compressor section 46. Rather, with reference to FIG. 5, the secondary air flow system 124 can comprise a remote or external source 234 of higher static pressure air, which can be injected into a respective one of the stators 144-148. The external source 234 is illustrated schematically in FIGS. 4 and 5 as being outside of the shroud 30, and thus, remote from the HP compressor section 28. It will be understood, however, that the external source 234 can comprise a source of air external to the gas turbine engine 10 itself, and thus, the location of the external source 234 in FIGS. 4 and 5 is merely exemplary. The external source 234 can be in communication with the tube 188 through any suitable device, such as a tube, strut, etc. to introduce the higher static pressure air into the plenum 180.

In addition, it should be understood that the secondary air flow system 124 can include a valve 230 to control the flow of the air through the tube 188. Generally, the valve 230 can comprise any suitable mechanical or electro-mechanical device that is movable between an opened position to allow the flow of air through the tube 188 and a closed position to prevent the flow of air through the tube 188, and various positions there between, if desired, as known to those skilled in the art. In one example, the valve 230 can be disposed in the tube 188, however, the valve 230 can be positioned at any desired location to control the flow of air into the plenum 180. Further, the valve 230 can be in communication with a control module 232, which is illustrated schematically in FIGS. 4 and 5. The control module 232 can be associated with or part of an engine control module for the gas turbine engine 10, and thus, it should be noted that the location of the control module 232 in FIGS. 4 and 5 is merely exemplary. Based on the receipt of sensor data measured and observed by one or more sensors associated with the axial compressor section 46 and/or the gas turbine engine 10, input from other modules associated with the gas turbine engine 10 or upon the receipt of user input, the control module 232 can output the one or more control signals to the valve 230 to move the valve 230 between the opened position and the closed position. Thus, the secondary air flow system 124 can be controlled via the control module 232 and the valve 230 based on the requirements of the gas turbine engine 10. It should be noted that the use of the valve 230 is merely exemplary, as the secondary air flow system 124 can be a passive system or can always be in operation (i.e. not controlled by a valve 230) so long as downstream higher static pressure air is available for use by the secondary air flow system 124.

In the example of FIG. 4, the secondary air flow system 124 directs fluid into the stator 148 to disrupt the hub flow of air through the stator 148, which in turn causes the air to flow towards an outboard region, a terminal end or tip **156*a* of the blades 156 of the rotor 142, thereby decreasing the pressure gradient at the tip 156*a* of the rotor 142 and improving the range of the rotor 142 to stall. In this example, the secondary air flow system 124 includes a plenum 224. It should be noted that the use of the plenum 224 is merely exemplary, as the secondary air flow system 124 can include any suitable passage or conduit for directing a secondary air flow into the tube 188. The plenum 224 is defined by the rotor portion 192 and the stator portion 194 of the seventh stage shroud housing 166, and a portion of the shroud 30. For ease of understanding, the plenum 224 is illustrated in FIG. 4 in broken lines, however, it will be understood that the plenum 224 is defined by the structure of the seventh stage shroud housing 166 and a portion of the shroud 30. The plenum 224 is disposed adjacent to the stator 150 to receive a portion of the air exiting the stator 150, which enters into the plenum 224 at a portion of the plenum 224 generally identified as 228**.

In this example, as air enters the axial compressor section 46 from the fan section 12 (FIG. 2), with reference to FIG. 3, the air flows through the inlet guide vane system 128 and is turned and accelerated by the rotor 136 in the stator frame of reference. The air exiting the rotor 136 enters the stator 144, and the stator 144 increases the static pressure of the air and directs the air into the rotor 137. From the rotor 137, the stator 145 further increases the static pressure of the air and directs the air into the rotor 138. The rotor 138 further turns and accelerates the air, and the air enters the stator 146. The stator 146 further increases the static pressure of the air, which is guided into the rotor 139. The rotor 139 further turns and accelerates the air, and the air enters the stator 147. The stator 147 increases the static pressure of the air, which is guided into the rotor 140. From the rotor 140, the air flows into the stator 148. The stator 148 increases the static pressure of the air and guides the air into the rotor 141.

With reference to FIGS. 4 and 5, the air turned and accelerated by the rotor 141 enters the stator 149 in a direction substantially perpendicular to a longitudinal axis L of the vanes 204. Provided that air is available downstream, air enters the plenum 224 of the secondary air flow system 124 and flows through the plenum 224 to the plenum 180. As the air exiting the stator 150 has a high static pressure, the air naturally flows into the plenum 224 without requiring additional features, such as a pump or flow guides, for example. The air from the plenum 180 exits the one or more openings 190 into the stator 149, flows through the interior passages 191 and exits into the hub cavity 213 via the one or more openings 210 in the hub 202. Thus, the secondary air flow system 124 directs higher static pressure air into the hub 202 of the stator 149. From the hub cavity 213, the air flows through the first gap 198 (FIG. 4), and back into the stator 149 flowfield near the first side 149*a* of the stator 149 where the flow of the main gas path air flow M is intentionally disrupted.

Figure 5A:
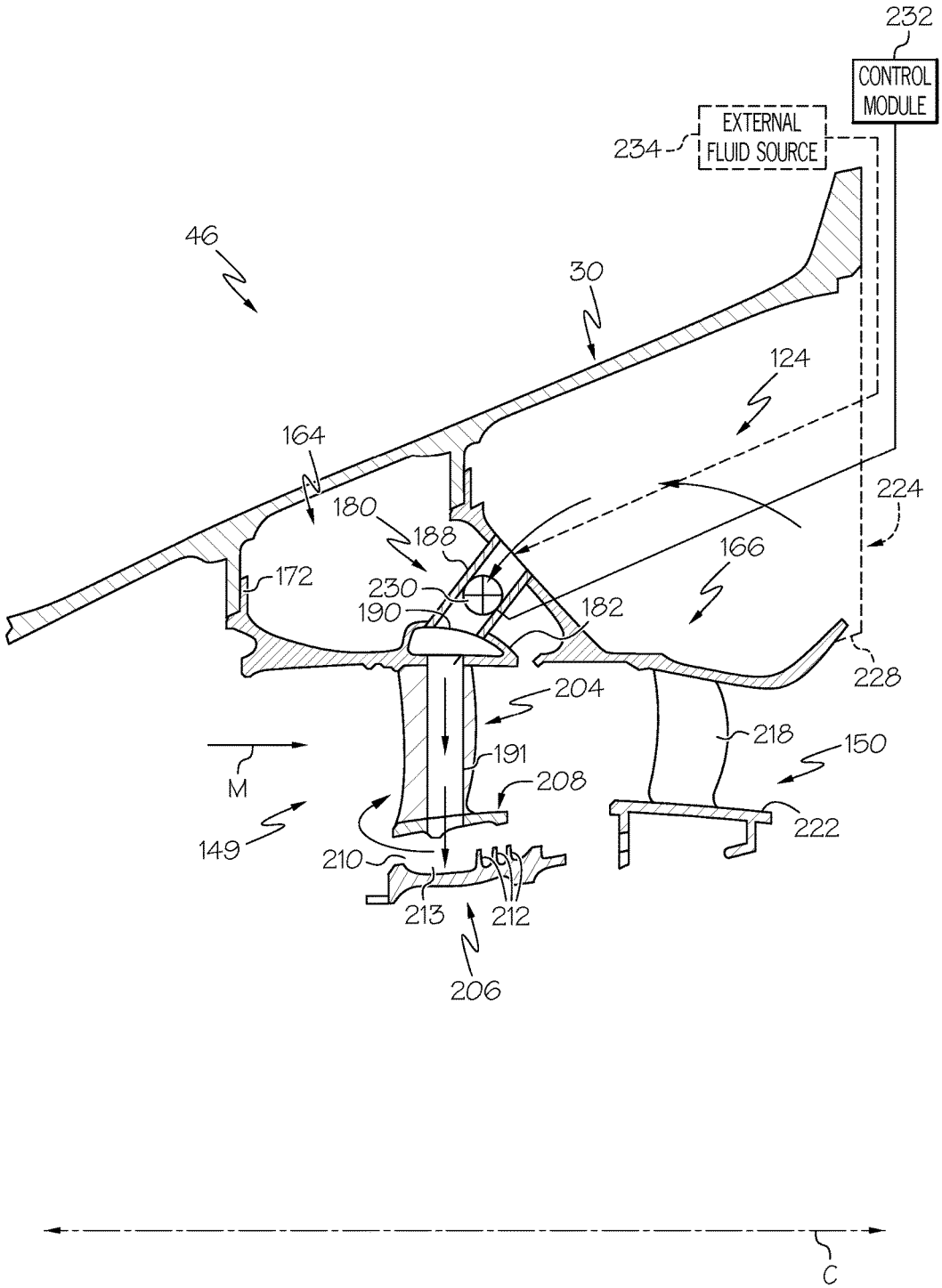
FIG. 5A is a further cross-sectional view of FIG. 5, taken along line 5A-5A of FIG. 5.

With reference to FIGS. 5 and 5A, a simplified view of FIG. 4 is shown. In FIGS. 5 and 5A, the rotors 141-142 have been removed to more clearly show the secondary air flow path through the secondary air flow system 124 into the hub 202 of the stator 149. As shown in FIGS. 5 and 5A, the air from the plenum 180 flows down through the stator 149, substantially parallel to the longitudinal axis L of the stator 149, and exits into the hub cavity 213 via the one or more openings 210. From the hub cavity 213, the air flows through the first gap 198 (FIG. 4), and back into the stator 149 flowfield near the first side 149*a* of the stator 149 where the flow of the main gas path air flow M is intentionally disrupted.

With reference to FIG. 4, from the first side 149*a* of the stator 149, the air is directed through the stator 149 into the rotor 142 and is displaced outward towards the outboard region and the tips 156*a* of the blades 156. The rotor 142 turns and accelerates the air, which enters the stator 150. The stator 150 further increases the static pressure of the air, and directs the air into the impeller 130 (FIG. 3). A portion of the air from the stator 150 also enters the plenum 224 at 228.

The secondary air flow system 124 decreases the pressure gradient acting on the outboard region and the tips 156*a* of the blades 156 of the rotor 142 by disrupting the air flow at the hub 202 of the stator 149 and moving the air flow in the stator 149 towards the outboard region and the tips 156*a* of the blades 156. By disrupting the hub air flow through the stator 149, the margin to stall of the rotor 142 is improved. In one example, the margin to stall of the rotor 142 is increased by about 3.0 percent (%) based on an increased flow of 1.0 percent (%) through the stator 149 from the secondary air flow system 124. The increased margin to stall of the rotor 142 raises the pressure ratio that can be achieved for a given mass flow at stage 7 of the axial compressor section 46, thereby improving at least one of the performance and the stability of the axial compressor section 46.

Figure 6:
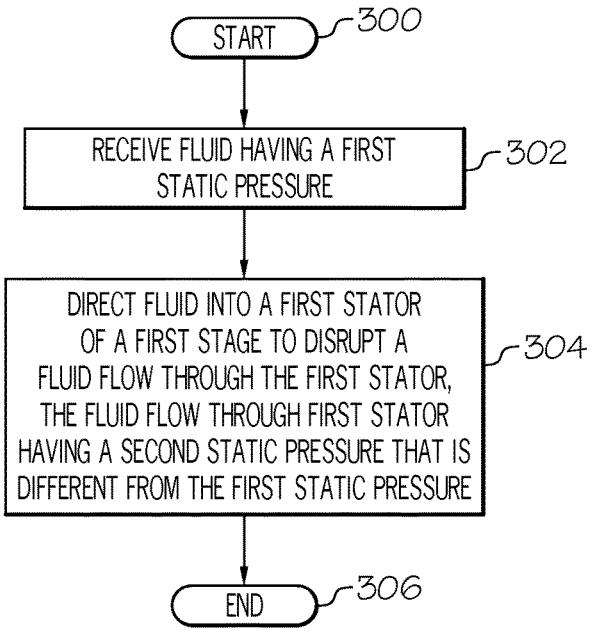
FIG. 6 is a flowchart illustrating an exemplary method for improving at least one of a performance and a stability of the axial compressor.

Thus, according to various embodiments, with reference to FIG. 6 and continuing reference to FIGS. 1-6, a method for improving at least one of the performance and the stability of the axial compressor section 46 is provided. It should be noted that as used herein, the term "stability" means the stall margin or stall line of the compressor. Thus, the method described and illustrated herein improves the stall margin or stall line of the axial compressor section 46. In one example, the method starts at 300. At 302, the method receives a secondary fluid, such as air, having a first static pressure. For example, the air is from a downstream stage, such as stage 2, stage 3, stage 4, stage 5, stage 6 or stage 7 of the axial compressor section 46 and has a higher static pressure. At 304, the method directs the secondary fluid, such as air, into the stator 144, 145, 146, 147, 148, 149 associated with an upstream stage (i.e. stage 1, stage 2, stage 3, stage 4, stage 5, stage 6) to disrupt a main fluid flow through the stator 144, 145, 146, 147, 148, 149 in which the main fluid flow through the stator 144, 145, 146, 147, 148, 149 has a second static pressure, which is different than the first static pressure. For example, the main fluid flow through the upstream stator 144, 145, 146, 147, 148, 149 has a second static pressure that is less than the secondary fluid received downstream at the first static pressure. In one example, the method directs the fluid, such as air, into the stator 144, 145, 146, 147, 148, 149 associated with an upstream stage (i.e. stage 1, stage 2, stage 3, stage 4, stage 5, stage 6) to disrupt a main gas path air flow M through a hub of the stator 144, 145, 146, 147, 148, 149. The method can direct the secondary fluid into the stator 149 at any suitable position or location to disrupt the main gas path air flow M through the stator 149, such as by directing secondary fluid into the stator 149 near the first side 149*a* of the stator 149, near the first end 149*b* of the stator 149 or through the interior passages 191, through the hub 202 into the hub cavity 213. Thus, directing the secondary fluid into the stator 149 does not necessarily require the secondary fluid flow directly into the stator 149, but the secondary fluid flow can be directed at the first side 149*a* of the stator 149 such that the secondary fluid flow disrupts the main gas path air flow M through the stator 149. By disrupting the main gas path air flow M through the upstream stator 144, 145, 146, 147, 148, 149 the performance and/or the stability of the axial compressor section 46 is improved. The method ends at 306.

It should be noted that while the secondary air flow system 124 has been described and illustrated herein for improving the performance and/or the stability of the axial compressor section 46, the present teachings of this disclosure can be applied to other portions of the gas turbine engine 10 to improve a performance and/or a stability. For example, with reference to FIG. 2, a secondary air flow of downstream air, such as air from the HP compressor 28, can be directed upstream into the fan 22. The secondary air flow can be introduced into the fan 22 via any suitable technique, such as a bore, tube, strut, etc. As a further example, with continued reference to FIG. 2, a secondary air flow of downstream air, such as air from the HP compressor 28, can be directed upstream into the LP compressor 26. The secondary air flow can be introduced into the LP compressor 26 via any suitable technique, such as a bore, tube, strut, etc.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A compressor, comprising:

a main fluid flow through the compressor;

a first stage having a first rotor and a first stator positioned such that a gap is defined between the first stator and the first rotor, the first stator having a first end, a hub and at least one vane extending along a longitudinal axis from the first end to the hub, the hub defining one or more openings, the first stator having a first side upstream from a second side in a direction of the main fluid flow through the compressor, and the first rotor including a rotating seal coupled to the first rotor so as to be disposed a distance away from the hub to define a hub cavity, the rotating seal including at least one projecting seal, and the one or more openings of the hub are defined upstream from the at least one projecting seal;

a first stage shroud housing that encloses the first stage, the first stage shroud housing having a first rotor portion and a first stator portion, the first rotor portion extends to the first stator portion to enclose the first rotor and the first stator portion is coupled to the first stator, and the first stator portion extends from the first rotor portion to a terminal end;

a second stage downstream from the first stage in a direction of the main fluid flow, the second stage having a second rotor and a second stator, the second rotor having a plurality of blades, each blade of the plurality of blades having a tip proximate a second stage shroud housing;

the second stage shroud housing having a second rotor portion and a second stator portion, the second stage shroud housing spaced a distance apart from the terminal end of the first stage shroud housing, the second rotor portion encloses the second rotor and the second stator portion is coupled to the second stator;

a secondary flow system that directs secondary fluid from the second stage into the first stator to improve at least one of a performance and a stability of the compressor, the secondary flow system including a second plenum defined by the second rotor portion and the second stator portion of the second stage shroud housing; and a first plenum defined in the first stator portion of the first shroud housing, the first plenum in communication with the second plenum of the second plenum of the secondary flow system, the first plenum having at least one opening in communication with the first stator to direct the secondary fluid from the secondary flow system into the first stator at the first end, wherein the at least one vane includes an internal passage in communication with the at least one opening and in communication with the one or more openings of the hub such that the secondary fluid from the secondary flow system flows through the internal passage and into the hub cavity, and from the hub cavity, the secondary fluid from the secondary flow system flows through the gap into the main fluid flow at the first side of the first stator and disrupts the main fluid flow through the first stator, the disrupted main fluid flow flows outward from the first stator toward the tip of each blade of the plurality of blades.

2. The compressor of Claim 1, wherein the first plenum includes at least one tube that extends through the second rotor portion of the second stage shroud housing and is in communication with the second plenum of the secondary flow system.

3. The compressor of claim 1, wherein the second plenum has a first end in communication with the first stator and a second end in communication with the second stator.

4. A method of improving at least one of a performance and a stability of an axial compressor, the method comprising:

directing a main fluid flow through the axial compressor from a first stage to at least a downstream second stage, the first stage including a first rotor and a first stator, and the second stage including a second rotor and a second stator, the second rotor having a plurality of blades, each blade of the plurality of blades having a tip proximate a second rotor portion of a second stage shroud housing disposed over the second rotor;

receiving in a first plenum defined by a first stator portion of a first stage shroud housing a secondary fluid having a first static pressure from the second stage through a second plenum defined by the second rotor portion and a second stator portion of the second stage shroud housing, the second plenum in communication with the first plenum, the first stage shroud housing including the first stator portion coupled to the first stator and a first rotor portion that encloses the first rotor, the first stage shroud housing spaced a distance apart from the second stage shroud housing; and directing the secondary fluid into the first stator of the first stage and disrupting the main fluid flow through the first stator, the disrupted main fluid flow flowing outward from the first stator toward the tip of each blade of the plurality of blades of the second rotor, the main fluid flow through the first stator having a second static pressure that is less than the first static pressure, wherein the directing the secondary fluid into the first stator further comprises:

directing the secondary fluid into the first stator such that the secondary fluid flows from a first end of the first stator through an internal passage defined through a vane of the first stator and exits into a hub cavity defined between a hub of the first stator and a rotating seal coupled to a first rotor of the first stage, the secondary fluid flowing from the hub cavity through a gap defined between the first rotor and the first stator into a first side of the first stator disrupting the main fluid flow through the first stator, the first side of the first stator upstream from a second side of the first stator.

5. The method of claim 4, wherein receiving the secondary fluid having a first static pressure further comprises:

receiving the secondary fluid from a source remote from the axial compressor.

6. An axial compressor, comprising:

a shroud;

a main fluid flow through the axial compressor;

a first stage having a first rotor and a first stator positioned such that a gap is defined between the first stator and the first rotor, the first stator having a first end, a hub and at least one vane extending along a longitudinal axis from the first end to the hub, the hub defining one or more openings, the first stator having a first side upstream from a second side in a direction of the main fluid flow through the axial compressor, and the first rotor including a rotating seal having at least one projecting seal, the rotating seal coupled to the first rotor so as to be disposed a distance away from the hub to define a hub cavity, the one or more openings of the hub defined upstream from the at least one projecting seal;

a first stage shroud housing that encloses the first stage, the first stage shroud housing having a first rotor portion and a first stator portion, the first rotor portion coupled to the shroud and the first rotor portion extends to the first stator portion to enclose the first rotor, the first stator portion coupled to the first stator, and the first stator portion extends from the first rotor portion to a terminal end;

a second stage having a second rotor and a second stator, the second stage downstream from the first stage in a direction of the main fluid flow, the second rotor having a plurality of blades, each blade of the plurality of blades having a tip proximate a second rotor portion of a second stage shroud housing;

the second stage shroud housing having the second rotor portion and a second stator portion, the second stage shroud housing coupled to the shroud so as to be spaced a distance apart from the terminal end of the first stage shroud housing, the second rotor portion encloses the second rotor and the second stator portion is coupled to the second stator;

a secondary flow system that directs a secondary fluid adjacent to the second stator into the first stator to disrupt the main fluid flow through the first stator, the secondary flow system including a second plenum defined by the second rotor portion, the second stator portion and a portion of the shroud; and a first plenum defined in the first stator portion of the first shroud housing, the first plenum in communication with the second plenum of the secondary flow system, the first plenum having at least one opening in communication with the first stator to direct the secondary fluid from the secondary flow system into the first stator at the first end, wherein the at least one vane includes an internal passage in communication with the at least one opening and in communication with the one or more openings such that the secondary fluid from the secondary flow system flows through the internal passage and into the hub cavity, and from the hub cavity, the secondary fluid from the secondary flow system flows through the gap into the main fluid flow at the first side of the first stator and disrupts the main fluid flow through the first stator, and the disrupted main fluid flow flows outward from the first stator toward the tip of each blade of the plurality of blades.

7. The axial compressor of claim 6, wherein the secondary fluid from the secondary flow system is directed into the first stator in a direction substantially parallel to the longitudinal axis of the at least one vane.

8. The axial compressor of claim 6, wherein the first plenum includes at least one tube that extends through the second rotor portion of the second stage shroud housing and is in communication with the second plenum of the secondary flow system.

9. The axial compressor of claim 6, wherein the axial compressor further comprises a third stage and a fourth stage, the third stage and the fourth stage upstream from the first stage, the fourth stage including a third stator and the secondary flow system directs the secondary fluid into the third stator and disrupts the main fluid flow through the third stator.

* * * * *